United States Patent [19]

Stumpp et al.

[11] Patent Number: 4,671,232

[45] Date of Patent: Jun. 9, 1987

[54] FUEL INJECTION SYSTEM FOR SELF-IGNITING INTERNAL COMBUSTION ENGINES

[75] Inventors: Gerhard Stumpp, Stuttgart; Wilfried Sautter, Ditzingen; Wolf Wessel, Oberriexingen, all of Fed. Rep. of Germany

[73] Assignee: Robert Bosch GmbH, Stuttgart, Fed. Rep. of Germany

[21] Appl. No.: 245,820

[22] Filed: Mar. 20, 1981

[30] Foreign Application Priority Data

Mar. 22, 1980 [DE] Fed. Rep. of Germany ..... 3011097

[51] Int. Cl.[4] ..... F22B 17/10

[52] U.S. Cl. ..... 123/300; 123/447; 123/449; 123/503; 123/506

[58] Field of Search ..... 123/299, 300, 447, 449, 123/503, 504, 506, 496

[56] References Cited

U.S. PATENT DOCUMENTS

| | | | |
|---|---|---|---|
| 2,055,578 | 9/1936 | Hurst | 123/447 |
| 2,173,813 | 9/1939 | Bischof | 123/300 |
| 3,386,423 | 6/1968 | Vallin | 123/447 |
| 4,271,808 | 6/1981 | Kobayashi et al. | 123/506 |

FOREIGN PATENT DOCUMENTS

| | | | |
|---|---|---|---|
| 0508945 | 6/1939 | United Kingdom | 123/300 |
| 0973120 | 10/1964 | United Kingdom | 123/300 |

*Primary Examiner*—Craig R. Feinberg
*Attorney, Agent, or Firm*—Edwin E. Greigg

[57] ABSTRACT

A fuel injection system functioning with a reservoir, in which a quantity received by the reservoir is injected after the termination of pump supply for the purpose of prolonging the injection time.

20 Claims, 10 Drawing Figures

FUEL INJECTION SYSTEM FOR SELF-IGNITING INTERNAL COMBUSTION ENGINES

The invention applies generally to fuel injection systems for self-igniting internal combustion engines, and, in particular, to a fuel injection system having a fuel reservoir disposed intermediate an injection fuel pump and fuel injection nozzles.

BACKGROUND OF THE INVENTION

In a known fuel injection system of this type, the pump piston of the injection pump supplies fuel into the fuel reservoir until such time, toward the end of the compression stroke, as a valve has been pushed open by the fuel; the connection to a pressure line leading to a fuel injection nozzle is furnished by way of this valve. Only after this instant does the injection begin, its quantity being made up in part from the quantity already supplied into the reservoir. Although in this system the reservoir pressure is controllable, and despite a safety valve in the reservoir chamber, the fuel quantity supplied into the reservoir chamber for the most part does reach the point of injection (in other words, there are few losses), and the duration of injection does correspond more or less to the quantity of injection. However, the injection quantity itself is controlled by rotation of the pump piston which includes an oblique edge for determining the injection quantity; thus the intention of effecting fuel supply by way of the reservoir is to make the supply pressure substantially independent of the rpm. Since the pressure increases with an increasing supply quantity, because of the restoring force of the reservoir which increases in that case, the pressure control is effected in accordance with fuel quantity or load, instead of in accordance with rpm, as is conventional. However, engine manufacturers are requiring that at low rpm, for instance, in idling and at partial load, the injection duration should be relatively long, so as to attain quiet idling of the engine. The known apparatus described above is not capable of meeting this demand because the pressure control is made separate from the rpm; other conventional control means where only the rpm is a standard are equally unable to meet these demands.

In a different known fuel injection system, the prolongation of injection time during idling and partial load is effected by means of the outflow of a partial quantity, which is compensated for in terms of quantity because of the rpm governor. The quantity which has flowed out, however, is a lost quantity which is not utilized during the injection procedure.

OBJECT AND SUMMARY OF THE INVENTION

The fuel injection system according to the invention has the advantage over the prior art that the demands made by engine manufacturers, in particular for quiet idling but also for a reduction in toxic exhaust gases as well as pertaining to other engine characteristics, are attained substantially more easily and better than in the known systems. Particularly by providing a single combined reservoir for a multiplicity of fuel pressure lines, there is a substantial savings in cost as well.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
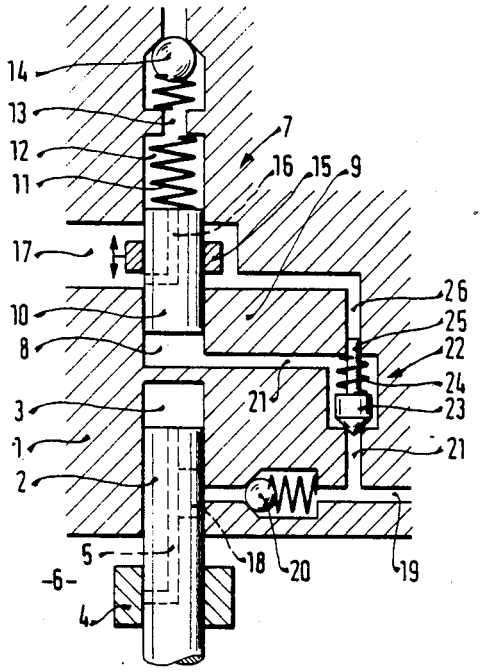
FIG. 1 is a schematic view of a first embodiment of the invention.

Referring now to FIG. 1, a pump piston 2, which simultaneously reciprocates and rotates, operates within the housing 1 of a fuel injection pump and together with the housing 1 defines a pump work chamber 3. The fuel injection quantity is determined by an annular slide 4 surrounding the pump piston 2, which is axially displaceable by a governor (not shown) and which controls a bore 5 extending within the pump piston 2 and discharging into the pump work chamber 3. After the bore 5 has been opened by the annular slide 4, the fuel can flow out of the pump work chamber 3 into the suction chamber 6 surrounding the annular slide 4. The pump work chamber 3 is supplied with fuel from the suction chamber 6 by conduits (not shown). This fuel injection pump cooperates with a reservoir 7 having a reservoir chamber 8, which is defined on one side by a housing 9 and on the other side by a reservoir piston 10. The reservoir piston 10 is stressed by a spring 11 disposed in a chamber 12 which is closed per se. The reservoir piston 10, in order to determine the reservoir pressure, is not only stressed by the spring 11, but is also exposed to the pressure prevailing in the chamber 12, which is controllable. The chamber 12 is supplied with fluid, in particular fuel, via a supply line 13 in which a check valve 14 is disposed.

In this first exemplary embodiment shown in FIG. 1, the pressure in the spring chamber 12 is controlled via an annular slide 15, which controls relief bore 16 in the reservoir piston 10. The relief bore 16 is connected at one end to the chamber 12, when the relief bore 16 is opened by the annular slide 15, it discharges at its opposite end into a chamber of lower pressure 17, which preferably communicates with the suction chamber 6. The reservoir piston 10 is accordingly stressed only by the spring 11 for the purpose of determining the reservoir pressure (reservoir 8) during the filling of the reservoir 8 and the corresponding displacement of the reservoir piston 10 past the annular slide 15, until such time as the bore 16 is blocked. From this instant on, a hydraulic pressure is established in supplementary fashion within the spring chamber 12. Depending upon the position which the annular slide 15 assumes, the onset of this build-up of reservoir pressure occurs earlier or later, and the reservoir volume thus enclosed is correspondingly smaller or larger.

During a compression stroke of the pump piston 2, the fuel flows out of the pump work chamber 3 through a distributor bore 18 extending from the bore 5 into one of the pressure lines 19, which lead to the fuel injection nozzles located on the engine. The number of pressure lines 19 disposed about the distributor is equal to the number of engine cylinders to be supplied with fuel. A check valve 20 is disposed between the pump work chamber 3 and this line 19, to prevent fuel from flowing from the line 19 back into the pump work chamber 3. A reservoir line 21 extends from this line 19 to the reservoir chamber 8. A standing pressure valve 22 is disposed within the reservoir line 21. This valve 22 comprises a movable valve element 23, which is stressed by a closing spring 24, and a pressure compensation piston 25, which extends into a chamber of lower pressure 26. As long as a lower pressure prevails in the pressure line 19 than in the reservoir chamber 8, the standing pressure valve 22, if it is closed, also remains closed. However, if it is open, then because of the pressure difference between the reservoir line 21 and the relief line 26, it is held open as a result of the cross-sectional surface area of the piston 25 which is effective in the open direction, until such time as the pressure in the pressure line 19 has fallen to the standing pressure.

The fuel injection system shown in FIG. 1 functions as follows:

As soon as the fuel injection pump 2, 3 starts supplying fuel to a fuel injection nozzle (not shown), then as a result of the hydrodynamic conditions and the respective adaptation between the exposed surface area and the effective springs of the injection nozzle and the fuel reservoir 7, a portion of the fuel quantity supplied by the injection pump 2, 3 reaches the reservoir chamber 8. This fuel quantity portion is determined by the annular slide 15. The reservoir pressure determined by the reservoir piston 10, the cross-sectional surface area and the reservoir spring 11 is in every case greater than the pressure which is required to keep the fuel injection nozzle open. As soon as the fuel injection pump has terminated its supply operation, the quantity of fuel placed in preliminary storage in the reservoir 8 is then supplied from the reservoir 8 to the injection nozzle and is injected. After the termination of this subsequent supply of fuel, the injection nozzle closes and subsequently the standing pressure valve 22 also closes, so that a new supply procedure may begin. The injection duration is, as a result, adjustable in any desired manner. The more fuel received into the reservoir 8, the longer the total injection duration. Because of this substantially independent capacity to determine the injection duration, optimal conditions pertaining to fuel consumption, noise and exhaust gas toxicity are attainable. The annular slide 15 can be actuated by a governor which appropriately takes into consideration the engine characteristics. Although only one reservoir line 21 has been shown in FIG. 1, the reservoir 7 may be used for all pressure lines of a single injection pump, depending upon the amount of time available or upon the planned maximum injection duration. When individual reservoirs 7 are required for the pressure lines 19, these reservoirs 7 may be disposed adjacent each other in a common housing, with their annular slides 15 connected to a common adjusting mechanism for simultaneously adjusting the fuel quantities reaching the reservoir chambers 8.

For the sake of better understanding, the exemplary embodiments and variants which will now be described are shown with parts corresponding to those in the first embodiment having the same reference numerals, and if the embodiment differs, then the reference numerals are provided with a prime.

Figure 2:
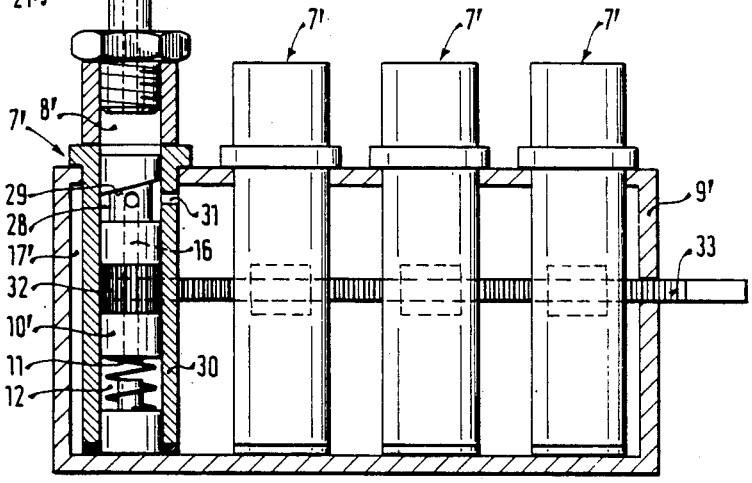
FIG. 2 is a side elevational view of a second embodiment of the invention, including a plurality of fuel reservoirs, with portions removed to show other portions therein.

In the second exemplary embodiment shown in FIG. 2, only the fuel reservoir is shown, without the fuel injection pump; here, four reservoirs 7' are combined into a battery or unit in one housing 9'. One of these four reservoirs 7' is shown in longitudinal section. As in the first ememplary embodiment, the fuel proceeds from the pump work chamber, not shown here, via the reservoir line 21' into the reservoir chamber 8'. The reservoir piston 10' is displaced counter to the reservoir spring 11. In order to control the pressure in the spring chamber 12, the bore 16 discharges into an annular groove 28 on the jacket face of the reservoir piston 10', which has an oblique limiting edge 29. The reservoir piston 10' operates in a sleeve 30, which is surrounded by a chamber 17' of lower pressure. A relief bore 31 is disposed in the sleeve 30 and, in the illustrated position of the reservoir piston 10', the relief bore 31 is closed earlier or later by the oblique limiting edge 29 in accordance with the rotary position of the reservoir piston 10'. As soon as this relief bore 31 has been closed, the pressure in the chamber 12' builds up. On the jacket face of the reservoir piston 10', a denticulation 32 is provided which cooperates with a gear rack 32 actuating all four reservoir pistons. In principle, this exemplary embodiment functions similarly to that described above.

Figure 3:
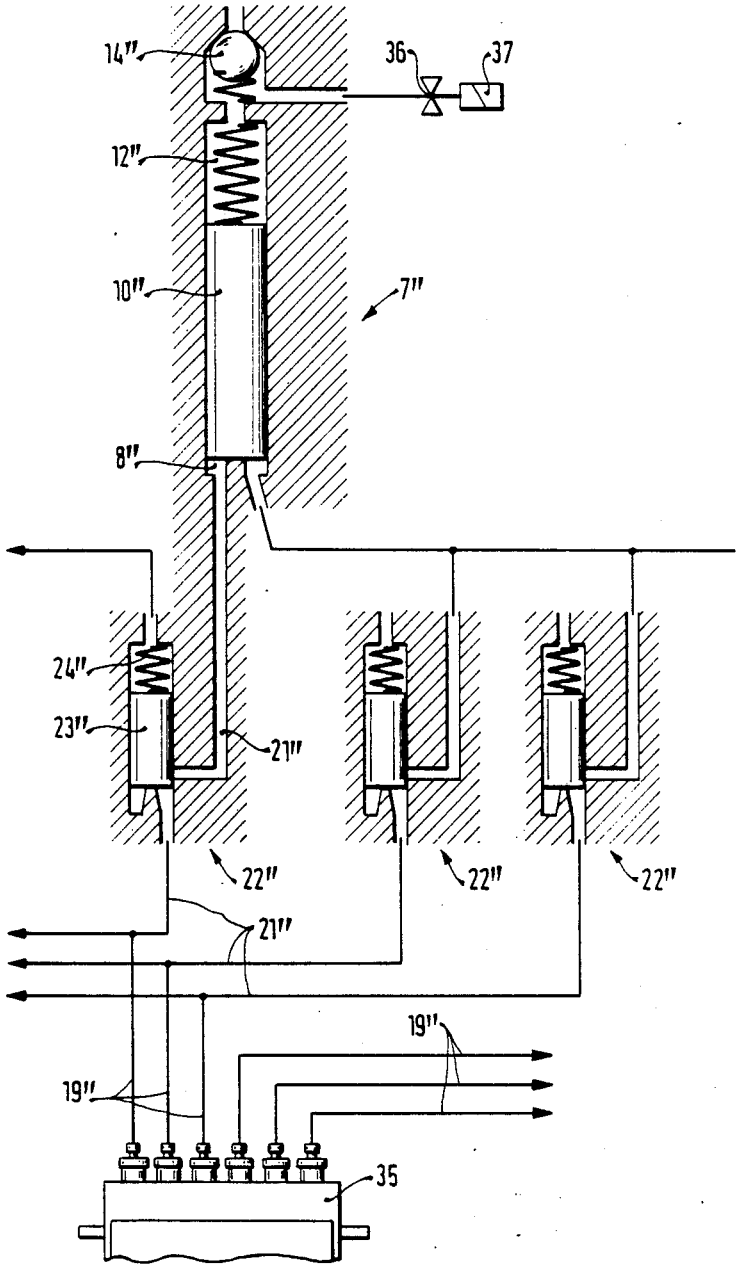
FIG. 3 is a schematic view of a third embodiment of the invention, comprising a series type injection pump and a single fuel reservoir.

In the exemplary embodiment shown in FIG. 3, a series pump 35 is used as the fuel injection pump; one pump cylinder is associated with each pressure line 19''. The standing pressure valves 22'' in the reservoir lines 21'' branching off from these pressure lines 19'' are embodied as piston valves, in which the piston 23'' stressed by the spring 24'' controls the passage of the reservoir line 21'' by way of its end-face edge. In principle, these standing pressure valves 22'' function like those of the first exemplary embodiment.

In this exemplary embodiment, a multiplicity of fuel pressure lines 19'' communicate with a reservoir 7''; for example, all six pressure lines may communicate with the one reservoir 7''. Differing from the previous exemplary embodiments, no control is undertaken here by the reservoir piston 10'' itself; instead, the pressure in the spring chamber 12'' is determined by means of a valve 36. The fuel flowing by way of the check valve 14'' into the spring chamber 12'' can flow out by way of the valve 36, until the outflow is stopped as a result of a switchover by a servo motor 37, which preferably functions magnetically. The reservoir volume in the reservoir chamber 8'' is thus determined via the servo motor 37 or the valve 36. It is also conceivable here that is may be solely the passage cross-section, and thus the outflow quantity per unit of time, which is determined, so that even when the outflow cross-section of the valve 36 does not change, the quantity of fuel received in the reservoir 8'' will vary in accordance with rpm and in accordance with load.

Figure 4:
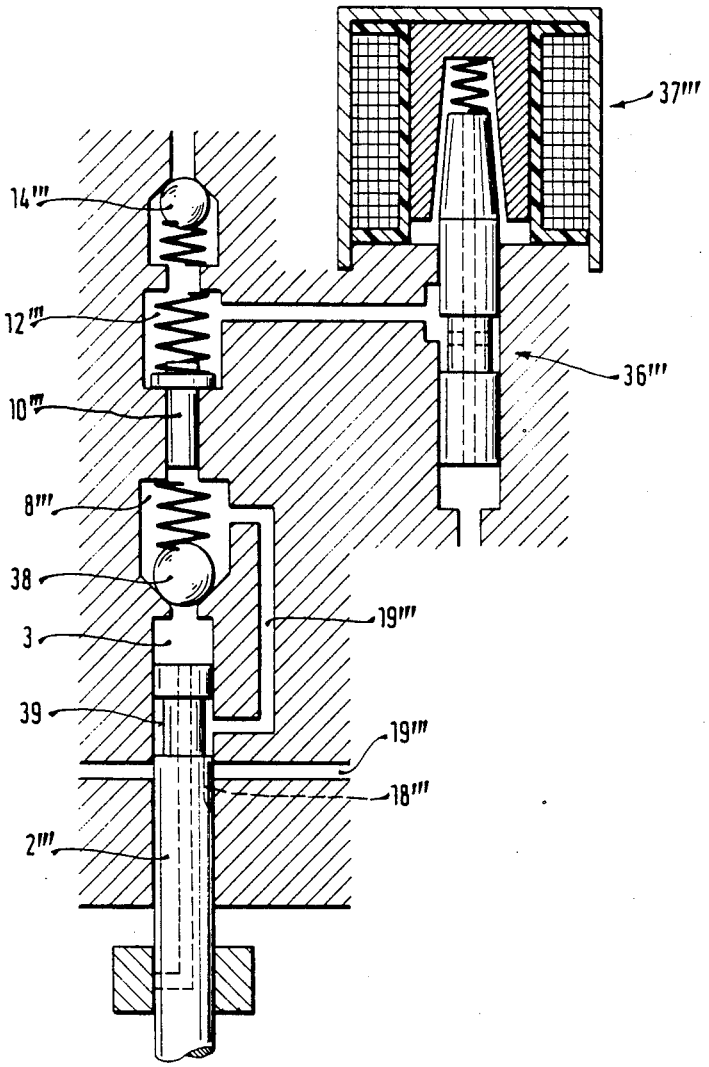
FIG. 4 is a schematic view of a fourth embodiment of the invention.

In the exemplary embodiments shown in FIG. 4, fuel is supplied from the pump work chamber 3 directly into the reservoir chamber 8''', by way of a check valve 38. From this reservoir chamber 8''', the pressure line 19''' leads back again to the distributor piston 2''', and then is directed by way of the distributor piston 2''', with the aid of an annular groove 39 and the distributor groove 18''', to the fuel injection nozzles.

Figure 5:
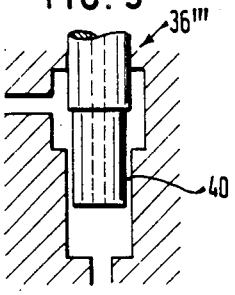
FIGS. 5 and 6 are schematic views of respective variations of the embodiment shown in FIG. 4.

The outflow from the spring chamber 12''' is effected in turn via a valve 36''', which is variable in its passage cross-section by means of a servo motor 37'''. The servo motor 37''' may be embodied as a rotary magnet, wherein each rotary position corresponds to a different passage cross-section at the valve 36'''. As shown in FIG. 5, the passageway of the valve 36''' may be embodied as a laminar slit 40, so that a compensation of the temperature-dependent viscosity of the fuel is effected. If the fuel or the fuel injection system is warmer, and the viscosity of the fuel has accordingly been reduced, the fuel passage time at the fuel injection nozzle is briefer than when the fuel is cold. If this is intended to be compensated for, then more fuel must be stored intermediately in the reservoir when the fuel or the system is warm, in order to assure the desired injection duration. With the laminar throttle shown in FIG. 5, more fuel flows through the laminar slit 40 when the engine is warm than when the fuel is cold, so that the reservoir piston 10''' is able to execute a longer deflection strike per injection.

Figure 6:
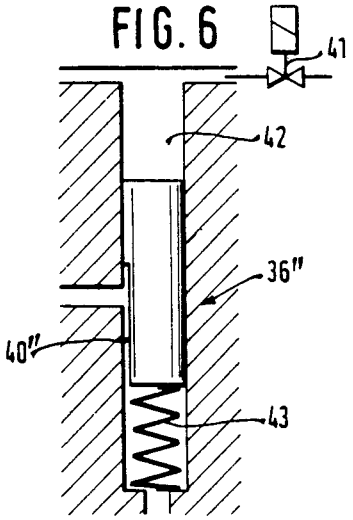

In FIG. 6, the outflow valve 36'' is embodied as a hydraulically actuated piston which controls the laminar gap 40'' and is displaceable counter to the force of a restoring spring 43 by means of a fluid accumulated in a chamber 42 as the result of the action of a magnetic valve 41. A magnetic valve 41 of this kind may function, for example, in a clocked manner or in such a manner as to determine a throttle cross-section.

Figure 7:
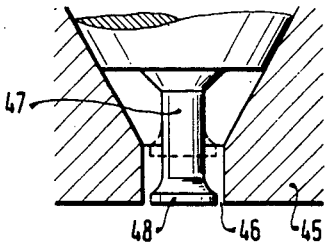
FIG. 7 is a side view of an outlet end portion of an injection fuel nozzle for use with the embodiments of FIGS. 3 and 4.

FIG. 7 shows an injection end portion of a fuel injection nozzle having a nozzle body 45, an injection opening 46 and a valve needle tang 47. A shoulder 48 is provided on the valve needle tang 47 oriented toward the combustion chamber. This shoulder 48 forms a constant aperture relative to the injection opening 46, in the form of an annular gap. As a result, it is assured that there is good adaption between the nozzle and the valve 36.

Figure 8:
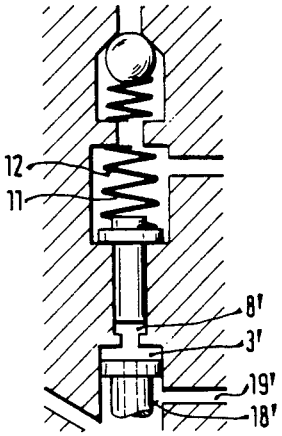
FIG. 8 is a schematic view of a variation of the embodiment shown in FIG. 2.
Figure 9:
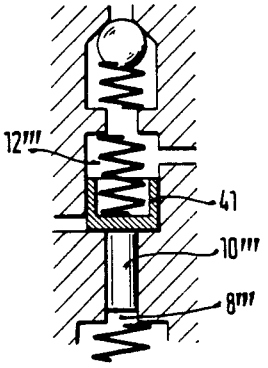
FIGS. 9 and 10 are schematic views of respective variations of the embodiment of the invention shown in FIG. 4.
Figure 10:
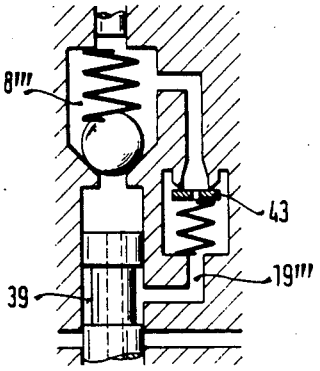

In the exemplary embodiment shown in FIG. 8, the pump work chamber 3' communicates directly with the reservoir chamber 8'; however, this makes substantial demands for the proper adaptation of the spring 11 and of the pressure in the spring chamber 12. The fuel is supplied directly into the pressure lines 19' from the pump work chamber 3' via the distributor groove 18'. In FIG. 10, a variant of the exemplary embodiment shown in FIG. 4 is shown, in which a throttle aperture acting in one direction is inserted in the pressure line 19''' between the reservior chamber 8''' and the annular groove 39 of the distributor. This assures that an aperture taking viscoscity into account is provided within the fuel guideway until injection; such an aperture may be described, for example, by an injection nozzle such as that described above. As a result, it is possible to effect an adaptation with a laminar throttle (FIGS. 5, 6) independently of the fuel injection nozzle.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection system for a self-igniting internal combustion engine, which comprises:

a plurality of fuel injection nozzles which open at a predetermined opening pressure;

injection pump means connected to said injection nozzles via respective fuel pressure lines for supplying pressurized fuel to each injection nozzle in sequence during successive pumping operations of the pump means;

a pump work chamber in said injection pump means;

at least one check valve in the fuel pressure lines to said injection nozzles for preventing reverse flow of fuel from the fuel pressure lines into the work chamber of said pump means;

fuel metering means for determining the fuel quantities supplied by the pump means; and a fuel reservoir means, connected with one pressure line, for delaying a portion of the fuel supplied to an injection nozzle by the pump means;

said one pressure line being connected downstream of said at least one check valve to respective fuel pressure lines leading to said injection nozzles, wherein during each pumping operation of the pump means a portion of the fuel being supplied to the corresponding injection nozzle is termporarily received by the fuel reservoir means and stored therein at a reservoir working pressure which is greater than the opening pressure of the injection nozzles, and wherein, after the termination of said pumping operation of the pump means, the portion of the fuel stored in the fuel reservoir means is supplied as a result of the reservoir working pressure to the injection nozzle which during said pumping operation has just been supplied with fuel.

2. A fuel injection system, as described in claim 1, wherein the injection pump means comprises:

an injection pump for supplying pressurized fuel;

a distributor means for sequentially directing the pressurized fuel to the injection nozzles; and a pressure line extending between the injection pump and the distributor means, for supplying pressurized fuel to the distributor means, the pressure line including a pressure valve for preventing reverse flow of fuel from the pressure line to the injection pump, and the pressure line being connected to the fuel reservoir means between the pressure valve and the distributor means.

3. A fuel injection system as described in claim 1 wherein the injection pump means comprises:

a distributor pump having a central pressure valve which, during opening, extends into the reservoir means; and said one pressure line extends between the reservoir means and a distributor portion of the distributor pump.

4. A fuel injection system, as described in claim 1, wherein the fuel reservoir means includes at least one reservoir assembly which comprises:

a housing;

a reservoir piston which is moveably disposed within the housing and which is stressed by a stressing element such as a spring;

a reservoir chamber defined by the housing and one side of the reservoir piston, and connected to at least one of the withdrawal lines; and a return chamber defined by the housing and an opposite side of the reservoir piston, which is connected by a check valve to a source of fluid whose pressure is controllable.

5. A fuel injection system, as described in claim 1, further comprising a standing pressure valve which is disposed respectively in said one pressure line, each standing pressure valve remaining open as long as a fuel pressure in said one pressure line is higher than said reservoir working pressure.

6. A fuel injection system, as described in claim 5, wherein each standing pressure valve opens in a direction of said fuel reservoir means and the closing force of each standing pressure valve is slightly higher than its opening force, which is made up of said reservoir working pressure and an exposed valve surface area.

7. A fuel injection system as described in claim 5, wherein:

the fuel reservoir means comprises a single reservoir; and said one fuel pressure line communicates with the single reservoir.

8. A fuel injection system for a self-igniting internal combustion engine, which comprises:

a plurality of fuel injection nozzles which open at a predetermined opening pressure;

injection pump means for supplying pressurized fuel to each injection nozzle in sequence during corresponding successive pumping operations of the pump means;

fuel metering means for determining the fuel quantities supplied by the pump means; and fuel reservoir means for delaying a portion of the fuel supplied to each injection nozzle by the pump means wherein said fuel reservoir means includes at least one reservoir assembly which comprises:

a housing;

a reservoir piston which is slidably disposed within the housing and which is stressed by a stressing element such as a spring;

a reservoir chamber defined by the housing and one end of the piston, which is connected to receive at least a portion of the pressurized fuel to be stored; and a return chamber defined by the housing and an opposite end of the piston, which is connected by a check valve to a source of fluid whose pressure is controllable.

9. A fuel injection system, claim 8, wherein the reservoir piston is embodied as a stepped piston having a larger diameter toward the return chamber.

10. A fuel injection system as described in claim 8, wherein the reservoir assembly further includes a controllable relief means for relieving pressure within the return chamber.

11. A fuel injection system, as described in claim 10, wherein the controllable relief means comprises:

a sleeve surrounding the reservoir piston; and a relief channel which is defined by the reservoir piston and includes a radial discharge area, the relief channel extending through the piston from the return chamber to the radial discharge area which is opened and closed by the sleeve during the piston's stroke.

12. A fuel injection system as described in claim 11, wherein the reservoir piston is guided in the housing by at least its end sections in order to define the reservoir chamber and the return chamber, and wherein the sleeve comprises an annular slide which is displaceable along a central, unguided section of the reservoir piston.

13. A fuel injection system, as described in claim 12, wherein said at least one reservior assembly comprises a plurality of reservoir assemblies, and the system further comprises:

a common housing block within which the reservoir assemblies are disposed; and adjusting means for simultaneously displacing the annular slides of the reservoir assemblies.

14. A fuel injection system, as described in claim 11, wherein:

the reservoir assembly housing includes the sleeve of the controllable relief means, said sleeve being a cylindrical sleeve which defines a relief bore extending radially there through, the reservoir piston being disposed within the cylindrical sleeve for reciprocatory and rotary movement therein;

the radial discharge area of the reservoir piston is formed as an annular groove in the jacket face of the reservoir piston having at least one oblique side; and the relief channel of the controllable relief means is formed as a blind bore extending from the return chamber within the reservoir piston and communicating with the annular groove in the jacket face of piston, which is opened and closed to the relief bore extending through the cylindrical sleeve during reciprocating movement of the reservoir piston.

15. A fuel injection system, as described in claim 14, wherein said at least one reservoir assembly comprises a plurality of reservoir assemblies, and the system further comprises:

a common housing block within which the reservoir assemblies are disposed; and adjusting means for simultaneously adjusting the rotary positions of the reservoir pistons, to thus simultaneously adjust the opening and closing of the relief channels during reciprocatory movement of the pistons.

16. A fuel injection system, as described in claim 10, wherein the controllable relief means comprises:

a relief channel extending from the return chamber; and a control valve, which is disposed in the relief channel, for controlling the return chamber pressure.

17. A fuel injection system, as described in claim 16 which further comprises an electrical servo motor, such as a magnet, for controlling the control valve.

18. A fuel injection system, as described in claim 16, wherein the control valve is embodied as a slide valve having overlapping laminar faces.

19. A fuel injection system, as described in claim 18, wherein the length of the overlapping of the slide valve laminar faces is variable as a means of temperature compensation.

20. A fuel injection system, as described in claim 16, 18 or 19, wherein the control valve includes a moveable valve element, embodied as a slide, which is actuatable hydraulically by a pressurized fluid counter to a spring, the system further including a magnetic valve means for controlling the pressure of the fluid actuating the slide.

* * * * *